United States Patent [19]

Seiffert et al.

[11] Patent Number: 5,061,867

[45] Date of Patent: Oct. 29, 1991

[54] ELECTRIC MOTOR DRIVE FOR A SPINDLE OF A SPINNING MACHINE

[75] Inventors: Harry E. Seiffert, Baden, Switzerland; Gustay Fetzer, Gingen, Fed. Rep. of Germany

[73] Assignees: Zinser Textilmaschinen GmbH, Ebersbach/Fils, Fed. Rep. of Germany; Asea Brown Boveri AG, Baden, Switzerland

[21] Appl. No.: 467,305

[22] Filed: Jan. 17, 1990

Related U.S. Application Data

[63] Continuation of Ser. No. 257,108, Oct. 13, 1988, abandoned.

[30] Foreign Application Priority Data

May 28, 1988 [DE] Fed. Rep. of Germany ..... 3818194

[51] Int. Cl.[5] ..... H02K 5/24

[52] U.S. Cl. ..... 310/51; 310/91; 57/100

[58] Field of Search ..... 310/51, 91; 57/100

[56] References Cited

U.S. PATENT DOCUMENTS

| | | | |
|---|---|---|---|
| 3,114,060 | 12/1963 | Goettl | 310/91 X |
| 3,483,407 | 12/1969 | Frohmüller et al. | 310/51 |
| 3,500,084 | 3/1970 | Sachio et al. | 310/91 X |
| 4,413,199 | 11/1983 | Fischer | 310/51 X |
| 4,420,926 | 12/1983 | Remontet | 57/100 |
| 4,425,813 | 1/1984 | Wadenstein | 310/91 X |
| 4,726,112 | 2/1988 | King et al. | 310/91 |
| 4,760,298 | 7/1988 | Dickie et al. | 310/91 |

*Primary Examiner*—R. Skudy
*Assistant Examiner*—Kristine Peckman
*Attorney, Agent, or Firm*—Shefte, Pinckney & Sawyer

[57] ABSTRACT

An electric motor drive for rotatably driving a spindle of a spinning machines has a resilient member positioned between an interconnecting member and a sleeve mounted to the spindle bank of the spinning machine. The resilient member is partially received in a recess in the interconnecting member, the sleeve or both to facilitate the distribution of forces exerted on the resilient member.

5 Claims, 2 Drawing Sheets

ELECTRIC MOTOR DRIVE FOR A SPINDLE OF A SPINNING MACHINE

This is a continuation of co-pending application Ser. No. 257,108, filed Oct. 13, 1988, abandoned.

BACKGROUND OF THE INVENTION

The present invention relates to an electric motor drive for a spindle of a spinning machine. More particularly, the present invention relates to an electric motor drive for a spindle rotatably supported in a bearing housing on the spindle bank of the spinning machine wherein a rotor is fixedly mounted on the spindle for driving by a stator mounted on the spindle bank.

The assignee of the present application is also the assignee of U.S. Pat. Nos. 4,904,892 and 4,905,534, each of which is directed to an invention which relates to the invention of the present application.

In a conventional electric motor drive having a stator and a rotor, the efficiency of the motor is increased if the radial spacing between the rotor and the stator is decreased. Additionally, the efficiency of the motor is increased if the radial spacing between the rotor and the stator is maintained at a uniform value.

SUMMARY OF THE INVENTION

The present invention provides an electric motor drive for driving the spindle of a spinning machine having a stator to which the axial, shear and tilting movements of the spindle can be transferred to the stator so that the space between the two can be efficiently minimal and the stator can absorb such movements so as to serve as a dampening element to minimize vibration of the spindle.

According to the present invention, the stator is mounted on an interconnecting member, which in turn is mounted on a sleeve that is mounted on the spindle bank, with a resilient member between the sleeve and interconnecting member and received in a recess in one or in recesses in both of the sleeve and interconnecting member. Preferably, up to one half of the extent of the resilient member is received in the recess or recesses, and the resilient member is adhered to the sleeve and the interconnecting member. With this construction differential spring rigidity characteristics of the resilient member which result from the various tension, compression and shear forces exerted upon it are, in the axial and radial directions, controlled toward a uniform value.

DETAILED DESCRIPTION OF THE PREFERRED EMBODIMENTS

Figure 1:
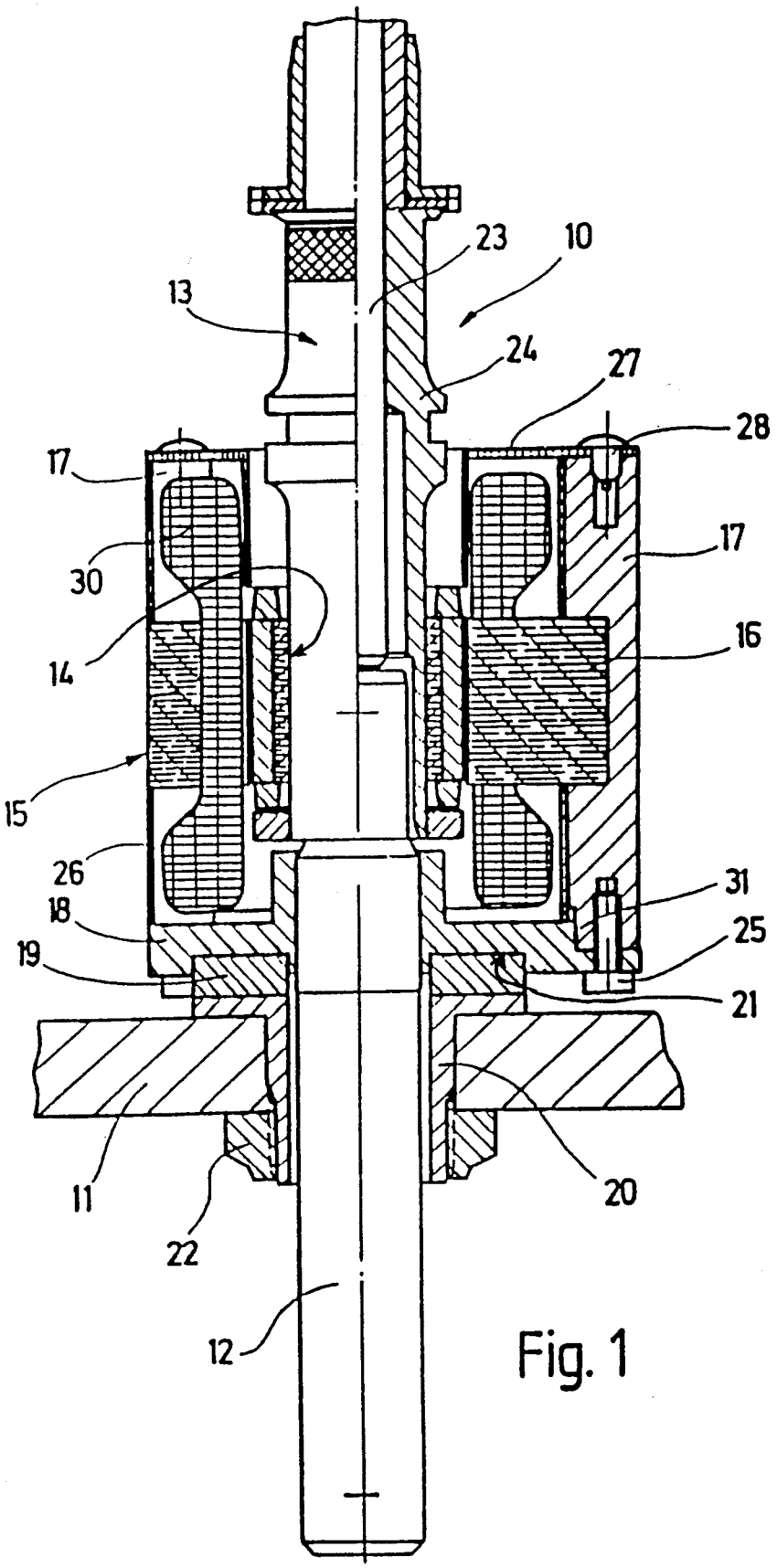
FIG. 1 is a vertical cross-section of an electric motor drive of one preferred embodiment of the present invention.
Figure 2:
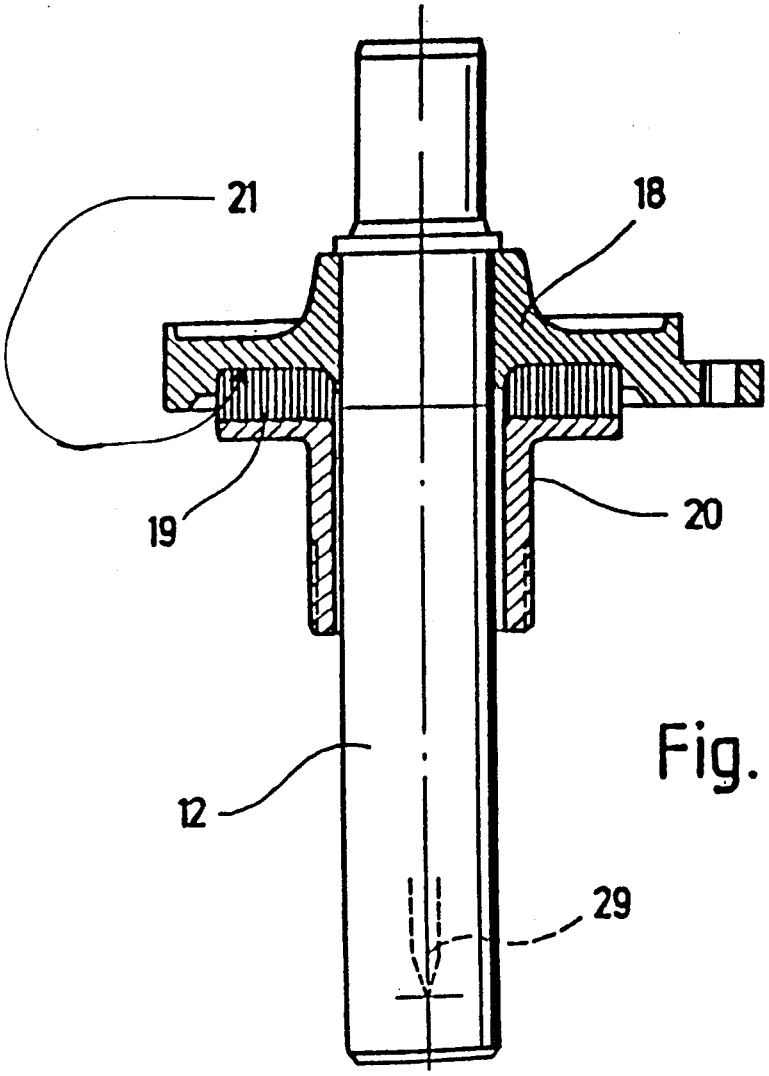
FIG. 2 is a vertical cross-section of the resilient element and the cooperating electric motor mounting structure of one modification of the preferred embodiment of the present invention.

In FIG. 1, a preferred embodiment of the mounting of the present invention is illustrated on a spinning station 10 of a spinning machine and, in FIG. 2, one modification of the preferred embodiment shown in FIG. 1 is illustrated. At the spinning station 10, a spindle 13 is rotatably supported on a bearing housing 12 which is fixedly mounted on a spindle bank 11 of the spinning machine. The spindle 13 includes an inner axial portion 23 rotatably supported by means of a foot bearing 29, shown in FIG. 2, on the bearing housing 12 and an outer axial portion 24 coaxial with and fixedly mounted to the inner axial portion 23 and having a bell-like sleeve for surrounding the upper axial portion of the bearing housing 12.

A rotor 14 is coaxial with and fixedly mounted to the outer axial portion 24 of the spindle 13, and is rotated by a stator 15 in which the rotor is centrally disposed. The stator 15 includes a magnetic core 16 of generally square configuration, which can be a stack of individual magnetically active plates, and a plurality of coils 30. The four corner regions of the magnetic core 16 have a plurality of brackets 17 mounted thereto for securing the individual plates of the magnetic core 16 in stacked relation. The brackets 17 retain the individual plates in stacked relation with and are mounted to an interconnecting member 18 which is fixedly mounted by means of a collar to the bearing housing 12. Each bracket 17 includes an inwardly facing arcuate shoulder 31 on its lower axial end for cooperating with a compatibly configured cylindrical surface of the interconnecting member 18 to center the magnetic core 16 with respect to the interconnecting member 18. Each bracket 17 is secured to the interconnecting member 18 by a bolt 25 extending through a bore in the interconnecting member and into a threaded bore in the lower axial end of the bracket.

A pair of protective coverings 26 are respectively mounted between the interconnecting member 18 and the magnetic core 16 and above the magnetic core 16. The upper one of the pair of protective coverings 26 extends axially from the top of the magnetic core 16 to a protective cap 27 mounted to the upper axial end of the brackets 17 by a plurality of rivets 28 inserted therethrough into corresponding bores in the brackets.

A resilient element 19 is disposed between the interconnecting member 18 and a sleeve 20 inserted through a bore in the spindle bank 11. The inner diameter of the sleeve 20 is greater than the inner diameter of the bearing housing 12 which is coaxially received therein and the sleeve 20 is fixedly secured to the spindle bank 11 by a nut 22 threaded along the lower axial end of the sleeve.

As best seen in FIG. 2, the interconnecting member 18 includes a recess 21 along its bottom surface such as, for example, an annular recess, for receiving the resilient element 19 therein at least to a portion of its axial extent. The radial extent of the recess 21 is compatibly dimensioned with the radial extent of the resilient element 19 such that the element is snugly received therein. In one modification of the mounting, up to one half of the extent of the resilient element 19 is received within the recess 21. In another modification of the mounting, the resilient element 19 is adhered to the interconnecting member 18 and the sleeve 20.

Figure 3:
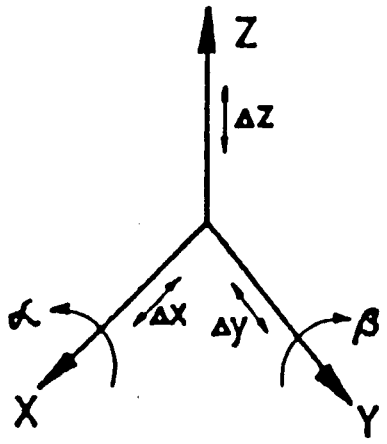
FIG. 3 is a schematic representation of a coordinate system defining the degrees of movement of a spindle of a spinning machine driven by an electric motor with the mounting of the present invention.

The axial, tilting and shear movements of the spindle 13 are transferred via the interconnecting member 18 to the resilient element 19. As illustrated in FIG. 3, the axial movement of the spindle is along the Z axis, the tilting movement of the spindle is along the X axis and the shear movement of the spindle is along the X and Y axes. The tipping movement of the spindle is indicated by the vectors theta and beta. Due to the engagement of the resilient element 19 in the recess 21, the different spring rigidity characteristics of the resilient element 19 due to the tension, compression and shear forces generated by the movement of the spindle 13, are controlled to substantially uniform values.

In another embodiment of the apparatus of the present invention, the resilient element 19 is received in, and engaged by, a recess in the top surface of the sleeve 20, which can be a substitute for or in addition to the recess 21 in the interconnecting member 18. In one modification of this embodiment, up to one half of the resilient element 19 is received in the recess of the sleeve 20.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. In a textile machine of the type having a spindle bank, an apparatus for rotating a bobbin during the building of textile material thereon, comprising:

a spindle having an axis for supporting a bobbin thereon during rotation of said spindle;

a rotor fixedly mounted to said spindle;

a stator for driving rotation of said rotor, said stator having a base;

means, fixedly connected to said stator, for supporting said rotor at a predetermined axial spacing above said stator base, said rotor supporting means rotatably supporting said rotor during driving rotation of said rotor and said rotor supporting means being connected to said stator for transmission of vibratory forces associated with driving rotation of said rotor from said rotor to said stator; and means for damping the transmission of vibratory forces from said stator to the spindle bank, said damping means including a resilient member disposed between and in contact with said stator base and the spindle bank, whereby said stator and said resilient member act to stabilize said spindle during a yarn package building operation by damping the vibratory forces generated by the rotation of said rotor.

2. In a textile machine, an apparatus according to claim 1 and characterized further by a sleeve fixedly mounted to the spindle bank and characterized further in that said stator base includes a recess and said resilient member is snugly received within said recess and is mounted to said sleeve.

3. In a textile machine, an apparatus according to claim 2 and characterized further in that up to one-half of the extent of said resilient member, as measured with respect to the axis of said spindle, is received within said recess.

4. In a textile machine, an apparatus according to claim 2 and characterized further in that said resilient member is adhered to said sleeve and said stator base.

5. In a textile machine, an apparatus according to claim 2 and characterized further in that said stator base includes an interconnecting member for interconnecting said stator and said rotor supporting means.

* * * * *